United States Patent [19]

Chodil et al.

[11] 4,099,082

[45] Jul. 4, 1978

[54] STACKED LATTICE SPACER SUPPORT FOR LUMINESCENT DISPLAY PANELS

[75] Inventors: Gerald J. Chodil, Boulder, Colo.; Alan Sobel, Evanston, Ill.

[73] Assignee: Zenith Radio Corporation, Glenview, Ill.

[21] Appl. No.: 730,114

[22] Filed: Oct. 6, 1976

[51] Int. Cl.[2] ..... H01J 61/10; H01J 61/30

[52] U.S. Cl. ..... 313/217; 313/220; 65/4 R

[58] Field of Search ..... 313/188, 475, 217, 220; 350/96 B; 65/4 R, 4 A, 43, 33, DIG. 7

[56] References Cited

U.S. PATENT DOCUMENTS

| | | | |
|---|---|---|---|
| 2,749,480 | 6/1956 | Ruderfer | 313/188 X |
| 2,925,525 | 2/1960 | Davis | 313/505 X |
| 3,253,896 | 5/1966 | Woodcock et al. | 65/43 X |
| 3,505,046 | 4/1970 | Phaneuf | 65/43 X |
| 3,790,849 | 2/1974 | Mayer et al. | 313/217 X |
| 3,829,734 | 8/1974 | Schofield | 313/217 |
| 3,837,727 | 9/1974 | Norton | 65/DIG. 7 X |

*Primary Examiner*—Palmer C. Demeo
*Attorney, Agent, or Firm*—John H. Coult

[57] ABSTRACT

For use in a luminescent display panel or the like, an extended-area, cellular spacer-support comprising a stack of mutually registered open lattices of filaments adhered together to form a latticework defining an array of narrow transverse openings therethrough which serve in the panel as radiation or particle passageways.

14 Claims, 13 Drawing Figures

STACKED LATTICE SPACER SUPPORT FOR LUMINESCENT DISPLAY PANELS

CROSS REFERENCE TO RELATED APPLICATION

This application relates to, but is not dependent upon the copending application Ser. No. 703,113, filed Oct. 6, 1976, of common ownership herewith.

BACKGROUND OF THE INVENTION

This invention is directed to an improvement in cellular spacer-support structures for luminescent display panels or the like. The invention is known to have utility when applied to flat display panels of the gas-discharge type, and especially to gas-discharge display, panels of the cellular type in which individual display elements, or groups of elements, are formed in discrete cells.

It is conventional in prior art gas-discharge display, panels of the cellular type to have an envelope including hermetically sealed front and rear slabs of glass. A regular array of gas-discharge cells is established within the envelope at the locations of the intersections of orthogonally arranged row-selection and column-selection electrodes. Gas discharges are selectively established at the intersections of excited pairs of row-selection and column-selection electrodes.

It is common to provide other electrodes for discharge ignition, for current modulation, for scanning the discharge, etc. In certain panels such as disclosed in U.S. Pat. No. 3,845,241, each gas discharge is coupled to a cathodoluminescent stage. Electrons are extracted from the gas discharge and accelerated in the cathodoluminescent stage to excite a phosphor on the inner surface of the viewing window.

The various types of gas-discharge panels, and many panels in general, require one, and in some cases a series, of insulative spacers for separating the various arrays of electrodes within the panel enclosure. It is also common in the prior art to impose on the insulative spacer structure the added function of providing mechanical support against the atmospheric pressure exerted on the extended surfaces of the evacuated panel enclosure. Gas discharge panels of various types having insulative spacers which appear to also provide structural support are disclosed, for example, in U.S. Pat. Nos. 3,921,021; 3,938,135; 3,798,483; 3,803,439; and 3,753,041.

The constraints imposed upon such insulative spacer-support structures are manifold and challenging. Two obvious requirements are that the structure be electrically insulative and capable of withstanding high compressive forces. Regarding the latter constraint, simple calculations will show that for a flat panel having, for example, a 30-inch diagonal measurement, several tons of atmospheric force are exerted on the face of the panel.

Another requirement imposed upon such spacer-support structures in many panel applications is that the cell passageways be relatively deep, compared to their smallest lateral dimension. For example, the passageways in some applications necessarily must each have a front-to-back depth which is many times its narrowest width dimension.

Further, it is desirable that the passageways be capable of being formed to very small lateral dimensions and be capable of being precisely located in order that high-resolution displays may be made. The spacer-support must be capable of withstanding thermal cycling and other operations to which the panel is subjected during its fabrication and assembly, without intolerable degradation in accuracy of dimensions of the overall structure or the passageways formed therein.

It is very important that the spacer-support structure be capable of manufacture at acceptably low cost. Desirably, the structure should be capable of being easily modified or tailored for added functions or unique applications. In some panel applications, it is desirable that the spacer-support facilitate conditioning of adjacent cells by permitting migration of ions and metastables to adjacent cells to condition them for ready ignition when selected.

Various approaches to fabricating insulative cellular spacer-support structures have been explored. Perhaps the most common method employed for fabricating such structures is by the use of photo-etching techniques. Such an approach is disclosed in such prior art U.S. Pat. Nos. 3,953,756; 3,789,470; and 3,777,206. One of the problems attending the use of certain etching methods is that the etched material is "undercut" at a rapid rate. The implication of this is (see U.S. Pat. No. 3,777,206) that if passageways are to be formed which are relatively deep compared to their lateral dimensions, then such a structure must be built up as a stacked plurality of mutually registered, separately etched layers. Inadequate dimensional accuracy and high cost also plague certain other etching methods.

An alternative approach, disclosed in U.S. Pat. No. 3,885,195 is to use a plurality of parallel glass ribs, shown as being trapezoidal in cross-sectional configuration, which are placed between front and rear slabs of a panel in order to provide the necessary insulation, support and spacing functions.

U.S. Pat. No. 3,953,756 suggest that an insulative spacer-support can be formed by machining a suitable material. U.S. Pat. No. 3,843,427 suggest that a spacer-support structure can be cast. Still another approach is disclosed in U.S. Pat. No. 3,611,019. The U.S. Pat. No. 3,611,019 shows a hollow, thin-walled glass box-like structure containing an interwoven single layer mesh of insulative fibers which support the thin walls of the structure. In the U.S. Pat. No. 3,611,019, the spacer-support also serves to contain the ionizable gas, excitation of which is achieved through the thin walls of the structure by orthogonally arranged electrodes disposed in contact with the opposite walls of the structure.

None of the prior art spacer-support structures have been found to be completely satisfactory. Most, if not all, have severe limitations in terms of their cost. Most of the prior art approaches are deficient in their ability to produce spacer-support structures having passageways whose individual depth is greater than its smallest lateral dimensions. Certain of these prior art approaches cannot meet the degree of accuracy in placement and configuration of the passageways which is required; other approaches fail when subjected to the severe thermal cycling operations which a panel must undergo during its fabrication. In short, there exists in the art prior to this invention a very strong need for an improved spacer-support structure for luminescent display panels.

As will be described in detail hereinafter, in accordance with this invention, a spacer-support structure is provided which comprises a stack of mutually registered lattices of filaments adhered together to form a rigid structure defining an array of passageways therein.

In this connection, reference is had to U.S. Pat. No. 3,829,734—Schofield. The Schofield patent does not concern the provision of a spacer-support structure, but rather discloses a technique for interweaving a fabric of glass fibers into a mesh of crossed column and row electrodes. The fibers act to space the electrodes and to capture the crossed electrode structure in a unitary fabric. As will be shown the present invention is applicable to pressurized as well as evacuated panels and can be utilized to resist positive as well as negative internal panel pressures.

OBJECTS OF THE INVENTION

It is a general object of this invention to provide for use in a luminescent display panel or the like a cellular spacer-support for spacing electrodes within the panel and/or for providing structural support for the panel.

It is a less general object of this invention to provide such a spacer-support which is capable of fine and precise structuring to permit the fabrication of high resolution displays.

It is another object to provide such a spacer-support in which cell passageways may be formed whose individual depth is many times its smallest lateral dimension.

It is yet another object to provide a spacer-support for flat display panels which is capable of withstanding thermal cycling of the panel during its fabrication, which is reasonably inexpensive to manufacture, and which provides for great flexibility in fabrication with opportunities for a wide range of auxiliary functions and characteristics to be introduced.

It is still another object to provide a spacer-support which may provide, if desired, for conditioning of adjacent cells.

OTHER PRIOR ART

U.S. Pat. Nos.: 3,808,497—Greeson, Jr.; 3,790,849—Mayer et al; 3,896,324—Galves et al; *Industrial Research,* November 1975, page 55.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Whereas the invention is believed to have applicability in a number of fields, it is known to be useful as applied to luminescent display panels, particularly flat display panels of the type wherein the individual image elements, or groups of elements, are formed in cavities or passageways in an insulative spacer-support structure. The spacer-support structure serves to space and electrically insulate electrodes in the panel, and in many cases also provides structural support for the panel against atmospheric loads exerted thereon.

Figure 1:
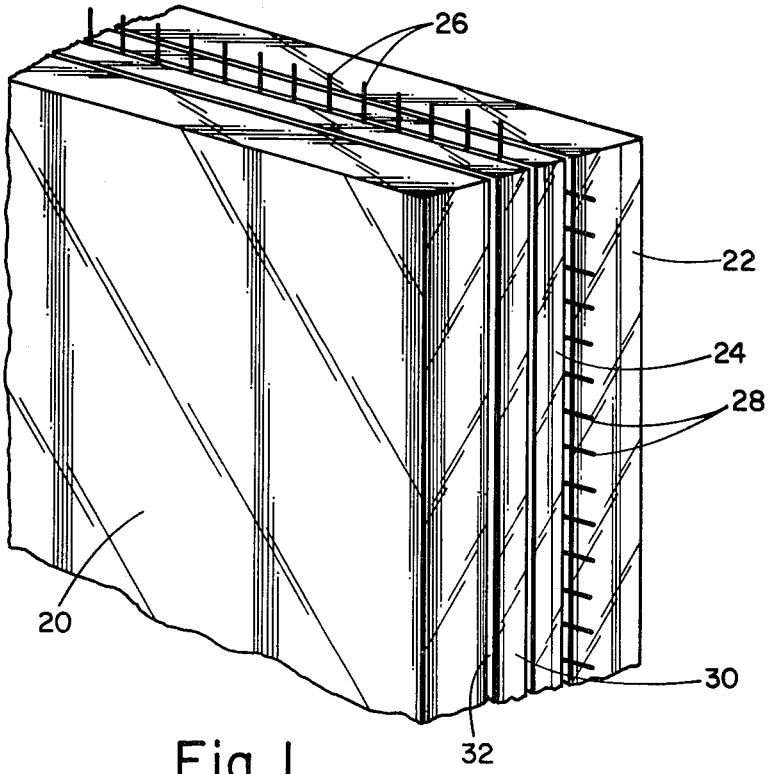
FIG. 1 is a fragmentary, schematic, generalized, perspective view of a luminescent flat display panel.

FIG. 1 schematically illustrates a corner of an evacuated, flat, gas discharge type luminescent display panel. The FIG. 1 panel is intended to be generalized in character, comprising a viewing window 20 and a rear plate 22, both typically glass slabs. Between the viewing window 20 and the rear plate 22 is an evacuated enclosure within which the luminescent display is formed. Gas discharges associated with particular image elements (or with groups of image elements) are formed in discrete passageways in an insulative spacer-support 24. In order to achieve selective excitation of the matrix of discharges, an array of column electrodes 26 and an orthogonally arranged array of row electrodes 28 are provided, the electrodes 26, 28 being arranged to cross in space at opposite ends of the image-element-associated passageways within which discharges are to be established.

The FIG. 1 panel is shown as including a second spacer-support 30. Between the viewing window 20 and the second spacer-support 30 is a luminescent screen which may include a high voltage anode 32. The second spacer-support serves to give mechanical support to the panel and also to electrically insulate the column electrodes 26 from the anode 32. The spacer-support 30 may, e.g., have passageways formed therein which comprise part of an electron extraction and acceleration stage. For example, in U.S. Pat. No. 3,845,241 a gas discharge display panel is illustrated wherein electrons are extracted from a gas discharge and accelerated through passageways in an insulative spacer-support into high-energy impact with phosphors on the inside surface of a viewing window.

Figure 2:
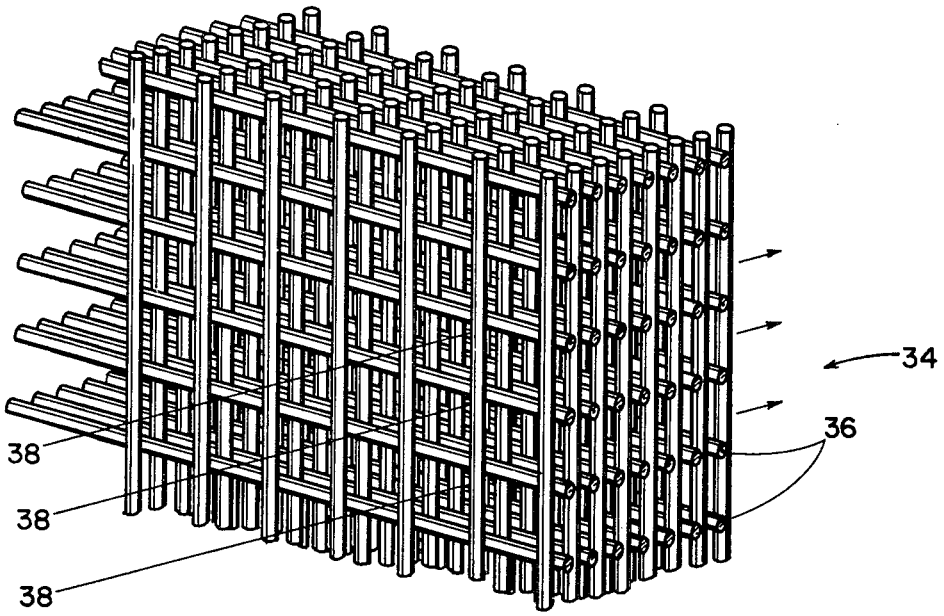
FIG. 2 is an enlarged schematic perspective view of a portion of a novel spacer-support constructed according to the present invention.

The present invention is directed to an improved spacer-support structure for use in luminescent display panels and the like. FIG. 2 is an enlarged schematic fragmentary view of a cellular spacer-support 34 constructed according to the teachings of the present invention. The spacer-support 34 comprises a stack of mutually registered lattices of cross-sectionally stable filaments 36 adhered to form a lattice-work defining an array of passageways 38 therein.

As used herein, the term "filaments" is used to mean the individual strands, fibers, threads, strings, canes, rods or other linear elements which are used as the basic building blocks from which a spacer-support according to the present invention is made up.

Figure 3:
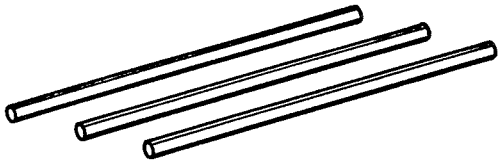
FIGS. 3–8 illustrate various configurations of lattices of filaments from which the spacer-support of the present invention may be built up.
Figure 4:
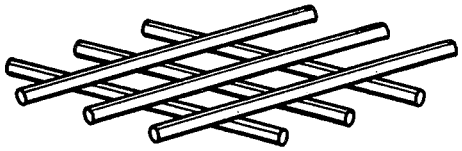
Figure 5:
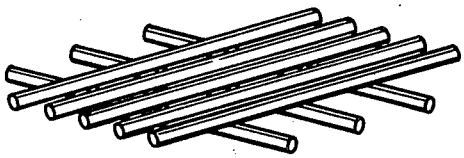
Figure 6:
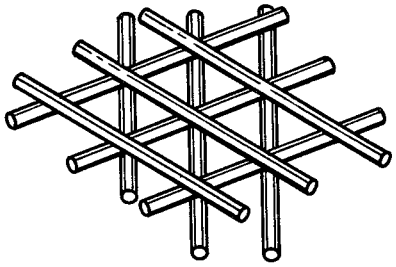
Figure 7:
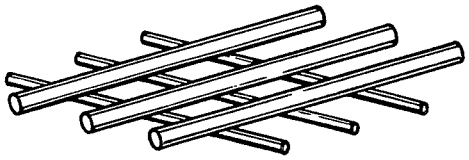
Figure 8:
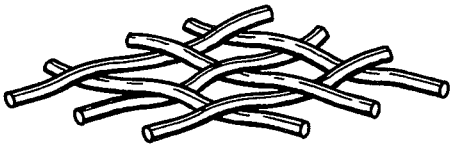

As used herein, the term "lattice" is used in a broad sense to mean one or more layers of filaments arranged and organized as a two-dimensional building block adapted to be stacked to form a spacer-support according to the present invention. For example, FIG. 3 shows a lattice composed of a single layer array of parallel filaments. FIG. 4 illustrates a lattice comprising a pair of crossed array of parallel filaments. FIG. 5 shows a lattice like the FIG. 4 lattice, but having the spacing of one array of filaments different from that of the other. FIG. 6 depicts a lattice composed of three layers of parallel filaments arranged at 60° with respect to each other. FIG. 7 shows a lattice in which the filaments composing one array are of a different diameter from those of an intersecting array. Alternatively, filaments of different size could be used within the same array to achieve desired spacing or other effects. FIG. 8 illustrates a lattice in which the filaments are not arranged in "log-cabin" style, but rather are interwoven in the warp and weft fashion of a clothing fabric.

As used herein the term "passageway" is intended to mean a channel for passing electrons, ions, metastables and/or electromagnetic rays, depending upon the application, and is meant to encompass not only openings through a spacer-support, but also cavities which are closed at one or both ends.

Turning again to FIG. 2 embodiment, the spacer-support 34 is composed of a stack of lattices (preferably dimensionally stable) forming a three-dimensional latticework. In this embodiment, the "lattice" may be interpreted as being either the single arrays of parallel filaments as shown in FIG. 3, or as pairs of crossed arrays of filaments as shown in FIG. 4. It should be understood, of course, that in accordance with the teachings of this invention, a spacer-support could as well be built up as a stack of lattices of many other lattice configurations including those shown in FIGS. 5–8.

In the majority of applications the spacer-support will act to insulate and space electrodes. In such applications the filaments 36 are electrically insulative and may be composed of a suitable insulative material such as glass. In a preferred embodiment, as will be explained in more detail hereinafter, the filaments are glass threads or other flexible filaments which are drawn taut in the desired configuration and then rigidified while in the tensed state. The use of threads which are drawn taut (and therefore straight) makes possible the fabrication of a fine, high-precision structure suitable for use in high-resolution luminescent display panels.

In order to rigidify the threads while in their tensed state, to form a dimensionally stable lattice and latticework, according to one aspect of the present invention, the stack of filamentary lattices is coated with a cement and the cement caused to harden to rigidify the entire structure and fuse together the individual threads. Various cements with the necessary properties are envisioned — for example, glass solders (both devitrifying and nondevitrifying), potassium silicate, and sodium silicate may be used.

In the FIG. 2 embodiment the lattices comprise criss-crossed arrays of filaments of equal spacing such that the spacer-support defines a periodic latticework defining passageways of like size and spacing. The FIG. 2 embodiment is a very useful embodiment in the construction of gas discharge display panels in which each passageway (or a small group of passageways) is associated with a particular image element (or group of elements).

In a preferred embodiment, the filaments are glass threads, for example Owens-Corning Fiberglas E12 glass threads of 0.010 inch diameter. The latticework, i.e., the stack of lattices, is coated with glass cement, for example Corning 7570 frit having a coefficient of thermal expansion which is approximately the same as that of the aforesaid glass threads.

The entire structure is baked to harden the glass frit. Once rigidified, the spacer-support becomes a fixed-form structure capable of withstanding very great compressive loads. By using very fine filaments, a structure can be built up in which the passageways are sufficiently small as to permit construction of a high-resolution display, and yet the passageways can be of a depth which is many times the smallest lateral passageway dimension.

In the FIG. 2 embodiment the filaments are arranged in "log-cabin" fashion, being rigidly joined at their intersections. Depending on the amount of cement that is applied, the filaments may be joined along their full length, in the manner of the "chinking" in a log-cabin. Alternatively, as where it is desired to have ions and/or metastable particles migrate from one cell to adjacent cells through the cell walls, it may be desirable to apply a reduced amount of cement effective to leave openings in the cell walls.

Whereas an application for a structure having nonperiodic arrays of filaments is not envisioned, there is no reason why a spacer-support according to this invention could not have filaments arranged in a nonperiodic arrangement. Rather than arranging the filaments in a log-cabin fashion, as mentioned above, they can be interwoven in the manner of the FIG. 8 lattice.

Figure 9:
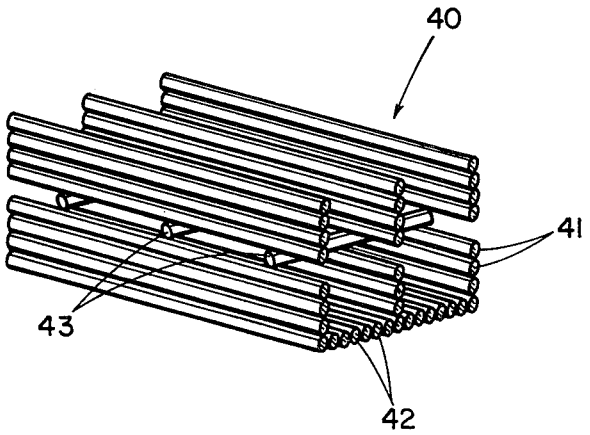
FIG. 9 illustrates an embodiment of the invention wherein the spacer-support defines transversely extensive passageways.

Another embodiment of the invention is illustrated in FIG. 9. In the FIG. 9 embodiment, the lattice which constitutes the basic building block of the spacer-support 40 is a parallel array of filaments 41, as shown in FIG. 3. By parallel-stacking lattices of such configuration, passageways are formed which are transversely extensive. Such a spacer-support may be useful, for example, in fabricating hollow cathode structures. Note that the FIG. 9 embodiment also teaches that a row of close-packed filaments can be arranged to define an end wall 42. The FIG. 9 embodiment includes an array of spaced bridge filaments 43 which add lateral support to the stacks of filaments.

Figure 10:
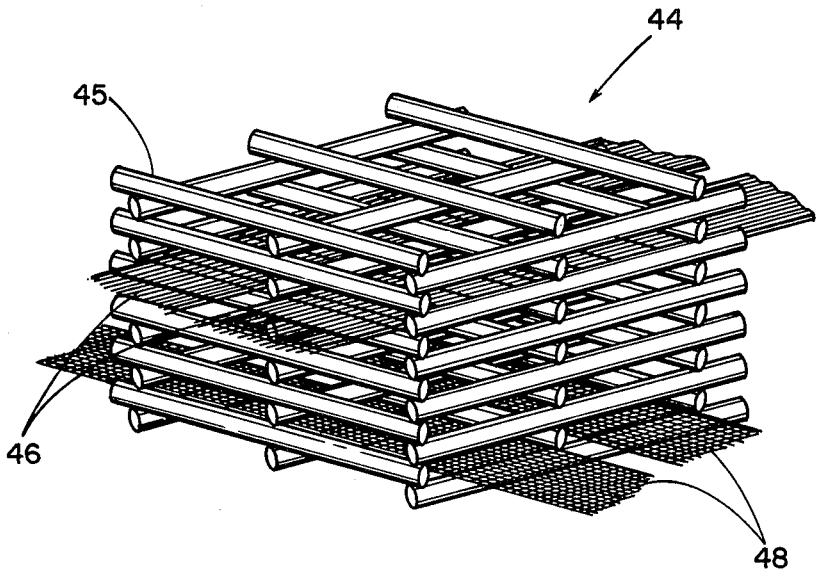
FIG. 10 illustrates another embodiment of the invention wherein electrodes are incorporated in the body of the spacer-support.

FIG. 10 depicts an embodiment which illustrates the versatility provided by the present invention. The spacer-support structure 44 is illustrated as being composed of a latticework of orthogonally criss-crossed arrays of filaments 45, as shown in the FIG. 2 embodiment. However, the FIG. 10 embodiment shows that in accordance with the present invention, building-block elements other than insulative filaments can be intercalated within, or disposed on the ends of, the filament stack. In the FIG. 10 embodiment, an array of electrodes 46, here shown as being column electrodes such as is depicted schematically at 26 in FIG. 1, are captured in the stack of filaments 45 which makes up the spacer-support structure 44. Another set electrodes 48, which may for example be the row electrodes 28 in FIG. 1, is intercalated at a different position in the latticework. The separation between the electrodes 46, 48 is determined by the number of lattices of filaments disposed between them.

By the use of a suitable glass or other cement, the electrodes may be fused into the stack to form part of the overall spacer-support structure. The electrodes 46, 48 may be of wire mesh, etched foil, simple single wires, or have any other suitable electrode construction. It will be understood that elements other than, or in addition to, electrodes may also be captured in the stack of filament lattices.

There will now be described a method for making a spacer-support following the teachings of the referent copending application. By way of example, a method will be described which is tailored to the fabrication of a spacer-support of the character shown in FIG. 2. The method for making a cellular spacer-support comprises, in general terms, forming a stack of mutually registered lattices of flexible filaments, including drawing the filaments taut while spacing them periodically such that the stack of lattices defines a periodic array of image-element-associated passageways in the stack. The lattice-work is then rigidified and mutually bonded to form a unitary cellular fixed-form structure. The method will now be described in more detail.

Figure 11:
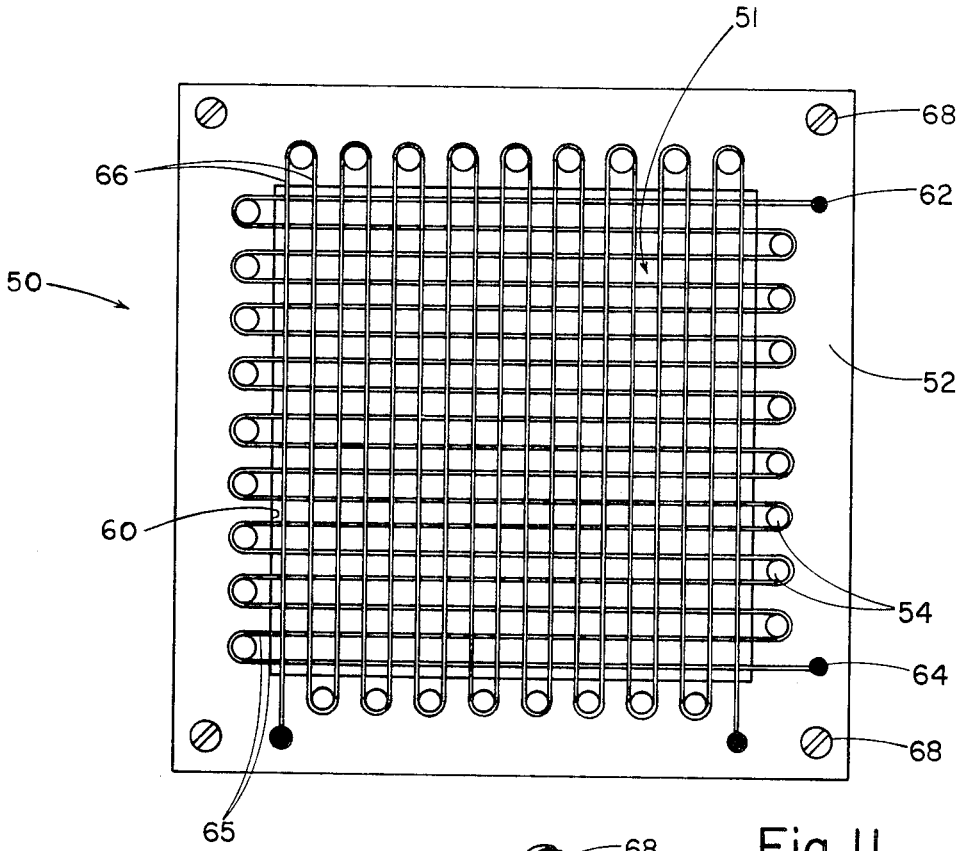
FIGS. 11 and 12 are plan and exploded perspective views of a fixture which may be used in a process for making spacer-supports according to the present invention.
Figure 12:
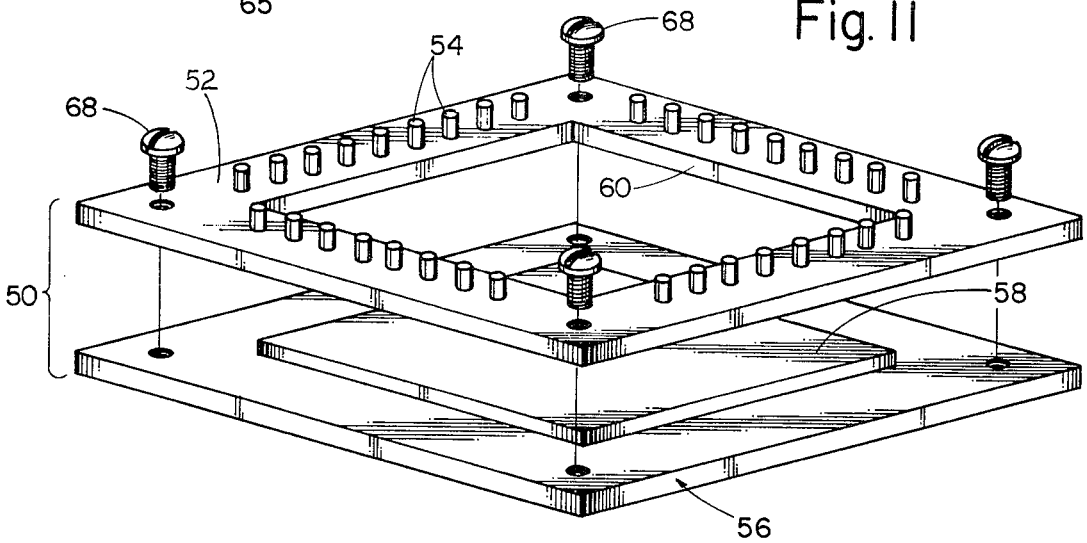

FIG. 11 is a plan view of a fixture 50 useful in the manufacture of a spacer-support according to this invention. FIG. 11 shows a stack 51 of lattices of flexible filaments, preferably glass threads, as they would appear after having been strung on the fixture 50. FIG. 12 is an exploded view of the fixture 50, with the threads removed for clarity of illustration.

The fixture 50 comprises a frame 52 having two orthogonal pairs of opposed, mutually staggered rows of pins 54 on which the filament is strung to form the afore-described stack of filament lattices. The frame 52 may be composed of cold-rolled steel. A base plate 56, which may be formed of "jig-plate" type cold-rolled steel, has a plateau 58 in the center which fits closely within the window 60 in the frame 52 when the two fixture components are mated.

To make a spacer-support by the method of this invention, in its preferred execution, a glass thread such as thread No. E12 made by Owens-Corning Fiberglas Corporation is secured to the frame, as with a screw or other fastener 62. The thread is then tightly wound in sinuous fashion back and forth over the staggered pins 54 until a warp of thread 65 is formed. The thread is then cut and adhered to the frame with another fastener 64.

The procedure is then repeated to form an orthogonal second warp of thread 66. Alternatively, the second warp 66 (and succeeding warps) can be wound as an uninterrupted continuation of the first. A stack of like lattices is then built up to form a spacer-support structure of the desired depth. The stack of filaments is then coated with a glass cement, preferably a cement which is matched closely in its coefficient of thermal expansion to that of the filaments. A suitable cement for use with the said thread is the frit No. 7570 (non-devitrifying) manufactured by Corning Glass Works which has a coefficient of thermal expansion which is approximately the same as that of the aforesaid glass thread. Alternatively, frit No. 7575 (devitrifying) by the same manufacturer may be used. The stack of lattices may be coated with the frit by spraying the cement in a liquid suspension, as with an air brush or other sprayer which produces a fine mist capable of coating all surfaces in the stack of filaments. To assure a coating uniformly the frame may be rotated while the stack is being sprayed from both sides.

To strengthen the frame and to eliminate any gravity-induced sagging of the filaments during the cement curing process, the frame 52 is mounted on the baseplate 56 with the plateau 58 closely fitting the window 60 in the frame 52. This may be done after the latticework is strung, but is preferably done before. Screws 68 are used to clamp the frame 52 to the baseplate 56. Before mounting the frame 52 on the base plate 56, the base plate is preferably sprayed with a release agent such as graphite.

The fixture is then placed in an oven and baked at a temperature appropriate to cure the frit; in this case a temperature of about 480° C may be used to cure the suggested Corning frit No. 7570.

By using a fixture of cold-rolled steel or some other material which has a thermal coefficient of expansion significantly greater than that of the glass threads, during the curing operation the fixture will expand to a greater extent than the threads 65, 66, causing the threads to be tensed to an even greater degree than they were when strung upon the frame 52. The frit will cure with the threads in their taut condition, thus assuring that the threads will be straight and accurately positioned as they are rigidified.

After the frit has cured, the fixture is removed from the oven and permitted to cool to room temperature. Due to the differential in coefficient of thermal expansion between the glass threads 65, 66 and the fixture 50, as the fixture cools down, the once-taut, uncoated ends of the thread which surround the pins 54 will relax and permit the resulting spacer-support structures to be easily removed from the fixture. The edges of the spacer-support are then trimmed and the structure is ready for use.

Figure 13:
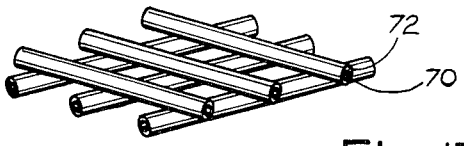
FIG. 13 depicts an aspect of yet another embodiment of the invention.

The invention is not limited to the particular details of the structure depicted, and other modifications and applications are contemplated. It is clear, for example, that a great variety of spacer-support structures can be made according to the present method merely by varying the pin placement and size parameters and by varying the composition, diameter and other parameters of the thread used to make up the structure. Rather than the spacer-support being fabricated from filaments of flexible threads, the filaments may be made up of other dimensionally stable structures such as semi-rigid canes which are precision-aligned and stacked in a special alignment fixture. The canes may be cemented by the method described. Alternatively, the canes may comprise glass rods as shown in FIG. 13 having a glass core 70 of relatively high melting point glass and an outer cladding 72 formed of a lower melting point glass. The canes are fused to form a unitary structure by baking the assembly at a temperature which will soften the cladding 72, but not the core 70. It is noted that only one set of a crossed set of canes need be clad. By the use of clad canes having a cladding of a lower melting point material, the canes will better retain their alignment and position as they are solidified together than if the canes were made from a homogeneous material.

As mentioned above, the filaments can be selected in a variety of sizes and compositions. It is not even necessary that they be of circular cross section. Glass filaments, both clad and unclad, can be drawn in various cross sections with great accuracy and uniformity. Filaments of metal or other electrically conductive material (with or without a cladding or coating of glass or other material) or insulative filaments having a coating of metal, nesa, or other suitable electrically conductive material could also be used.

The filaments can be made up of bundles of individual fibers or plies of fibers, which fibers, plies of fibers or bundles of fibers or bundles of plies can be individually and/or collectively clad or cement-coated before being made into a lattice or latticework. The filaments need not have a uniform diameter along the length, but could have bulges or bumps to determine the spacing between filaments.

The lattices could be stacked with a progressive lateral off-set, or otherwise constructed or arranged such that the passageways through the latticework are angled or otherwise directed, rather than being normal to the latticework as shown. Other methods for assembling the spacer-support structure may be employed.

As noted, whereas the principles of the present invention are believed to be best implemented in spacer-support structures used in evacuated display panels, the invention is readily adapted to use in positive pressure display panels. It is intended therefore that the subject matter in the above depiction shall be interpreted as illustrative and not in a limiting sense.

What is claimed is:

1. In a luminescent display panel or the like, an extended-area, cellular spacer-support comprising a stack of mutually registered open lattices of insulative filaments adhered together to form a latticework having an array of narrow transverse openings therethrough which serve in the panel as radiation or particle passageways.

2. For use in a luminescent display panel or the like, an extended area, cellular spacer-support comprising a stack of mutually registered open lattices of insulative, cross-sectionally stable filaments and means for adhering the filaments together at their intersections to form a compressionally rigid latticework having an array of narrow transverse openings therethrough which serve in the panel as radiation or particle passageways.

3. The spacer-support defined by claim 2 wherein said filaments are composed of glass and wherein said filaments are interstitially adhered together and rigidified with a cement.

4. The spacer-support defined by claim 3 which said cement comprises glass solder.

5. The spacer-support defined by claim 2 wherein said filaments comprise semi-rigid canes.

6. The spacer-support defined by claim 5 wherein said canes are composed of glass.

7. The structure defined by claim 6 wherein said glass canes have a lower melting point glass cladding which is fired to fuse said canes together.

8. The structure defined by claim 5 which said canes are stacked in log-cabin fashion and rigidly joined at their intersections.

9. The spacer-support defined by claim 2 wherein at least one of said lattices in said spacer-support includes an electrically conductive electrode captured therein so as to extend across at least one of said passageways.

10. For use in an evacuated luminescent display panel or the like, an extended area, cellular spacer-support comprising a stack of mutually registered open lattices of insulative cross-sectionally stable filaments and means for rigidifying the filaments and for adhering the filaments together at their intersections to form a rigid latticework having an array of narrow transverse openings therethrough which serve in the panel as radiation or particle passageways.

11. For use in a flat luminescent display panel or the like, an extended-area cellular insulative spacer-support comprising periodically spaced stacks of insulative filaments adhered together and rigidified to form a rigid structure which defines through said stacks of filaments transversely oriented openings which serve as image-element-associated radiation or particle passageways.

12. The spacer-support defined by claim 10 wherein said filaments are composed of glass and wherein said filaments are interstitially adhered together and rigidified with a cement.

13. For use in a luminescent display panel or the like, an extended area, cellular spacer-support comprising a stack of mutually registered open lattices of filaments each having a glass core and a lower melting point glass cladding, said filaments being fused together at least at their intersections to form a compressionally rigid latticework having an array of narrow transverse openings therethrough which serve in the panel as radiation or particle passageways.

14. In an evacuated luminescent display panel or the like, an extended-area, dimensionably stable, electrically insulative spacer-support for spacing electrodes within the panel and/or supporting the panel against atmospheric force, comprising a stack of mutually registered open lattices of cross-sectionally stable glass filaments adhered together at their intersections by a glass material having a melting point lower than that of the glass which constitutes said filaments, said stack forming a compressionally rigid latticework having an array of image-element-associated narrow transverse openings therethrough which serve in the panel as radiation or particle passageways whose individual depth is at least twice its smallest lateral dimension.

* * * * *